US005117763A

United States Patent [19]

Gustafson

[11] Patent Number: 5,117,763

[45] Date of Patent: Jun. 2, 1992

[54] HYDRATING FILTER SMOKESTACK SYSTEM

[76] Inventor: Leif V. Gustafson, 17902 Hyacinth Dr., Sun City West, Ariz. 85375

[21] Appl. No.: 570,398

[22] Filed: Aug. 21, 1990

[51] Int. Cl.[5] ..... F23J 15/00

[52] U.S. Cl. ..... 110/215; 55/233; 55/242; 55/403; 55/487; 110/184; 110/216

[58] Field of Search ..... 110/215, 216, 184; 55/233, 242, 351, 354, 353, 403, 487

[56] References Cited

U.S. PATENT DOCUMENTS 3,853,514 12/1974 Post ..... 55/354 X
4,416,855 11/1983 Abrams et al. ..... 110/215 X
4,451,441 5/1984 Ernest et al. ..... 55/487 X
4,625,661 12/1986 Melchior ..... 110/215 X
4,812,295 3/1989 Bresowar ..... 55/354
4,949,652 8/1990 Hadley ..... 110/215
4,958,578 9/1990 Houser ..... 110/215 X

*Primary Examiner*—Edward G. Favors

[57] ABSTRACT

A process for elimination of liquid hazardous waste, solid hazardous waste and medical waste. The waste material is incinerated in a rotary furnace to produce a gaseous phase, and a solid phase of non-combustible solids. The gaseous components with suspended particulates are passed to a waste heat boiler for cooling and elimination of some particulates. A mist-producing scrubber further reduces the quantity of particulates in the gases. Finally a chimney with hydrating filters collects and removes any remaining particulates. The invention is a fully closed unit that will emit no particulates into the atmosphere at an efficiency never before realized.

20 Claims, 4 Drawing Sheets

HYDRATING FILTER SMOKESTACK SYSTEM

BACKGROUND

1. Related Application

This specification is a revision of the patent application specification Ser. No. 07/488,124, filed Mar. 5, 1990 now abandoned.

2. Field of the Invention

The invention relates to the reduction of hazardous waste and medical waste to a disposable residue and in particular the elimination of lighter-than-air particles from entering the atmosphere.

3. Prior Art

At the present time we have 1,447 known hazardous waste dumpsites, of which 703 are on the government's priorities list for clean-up. The Environmental Protection Agency (EPA) expects that this figure will grow to about 2,500 dumpsites before too long.

Hazardous waste contains many dioxin residues which are highly toxic chemical contaminants. Storage of this type of waste creates many physical problems for inhabitants living in close proximity to the storage site.

Sooner or later all waste dumpsites will leak and consequently it is a foregone conclusion that we must not perpetuate landfill dumpsite storage systems.

A small percentage of hazardous waste and medical waste is being incinerated without adequate safeguards in preventing particles from being emitted into the atmosphere, thus augmenting the acid rain content of sulfur dioxide and nitrogen oxide emitted primarily from fossil fuel plants.

Occasionally beaches on both the Atlantic and Pacific oceans have been closed because of offshore dumpings of medical waste.

SUMMARY OF THE INVENTION

The invention provides a chimney where the top area of the gas passage void is enclosed with endless moving hydrating filters collecting particulates in the gas stream. A portion of the filters extend beyond the gas passage area where entrapped particulates are removed from the filters by a liquid spray. Particulates thus removed are flushed down a drain gutter for disposal.

The invention may be summarized as a waste elimination system wherein waste materials are incinerated in a manner which produces gaseous and particulate residues. These gaseous and particulate residues are intermixed as they pass through the system and the invention provides the means for separating the particulate residues from the gaseous residues so that these particulates may be safely disposed of. The invention is an improvement in such a waste elimination system in that it provides a hydrating filter chimney smokestack which includes a liquid-washed filter system within the chimney itself. Gaseous and particulate residues injected into the chimney are separated as they pass through the liquid-washed filters. The particulate residues are entrapped within the filter system and are thereafter flushed from the filters.

To this end the filter system includes a washed liquid supply and a washed liquid conduit coupled to that supply. Liquid is conducted from the supply through the conduit to the filters to flush the particulate matter from the filters. The particulate matter flushed from the filters is collected for safe disposal.

In a presently preferred embodiment, the filter system consists of one or more movable, endless-belt filters. In practice, a portion of these endless-belt filters extends outside the confines of the chimney so that flushing of the filters takes place outside the chimney and the flushed particulate matter may be readily collected for later disposal.

Included as part of the invention and claimed herein is a mist-filled scrubber which accepts a mixture of gaseous and particulate residues from the incinerator. The scrubber is so thoroughly filled with mist that there are no paths through which particulate matter may pass through the scrubber without encountering liquid particles. The particulate matter becomes wetted and thereby increases in density. As the density of the particulate residues increases, they tend to settle out and separate from the gaseous residues passing through the scrubber. Particulate residues so settling out are collected for later disposal. The disclosure and claims advocate the use of mist-producing means for injecting liquid particles into the scrubber as opposed to the course of water jets and water streams utilized with prior art with scrubbing devices.

The invention provides apparatus for high temperature combustion of toxic and dioxin contained materials in liquid hazardous waste, solid hazardous waste and medical waste.

Residue in this process is non-toxic and safely disposable. Lighter-than-air particulates are further treated and totally prevented from entering the atmosphere.

Hot gases with entrapped particulates enter a cooling chamber consisting of a waste heat boiler where some of the particles are removed. Cooled flue gases with remaining particulates are routed into a wet mist-producing scrubber where the greater portion of particulates are eliminated.

Any remaining particles, consisting of a multitude of subcompounds in the gases, are routed into a chimney equipped with multiple hydrating constantly moving filters.

In this process of complete entrapment of particulates, exhaust gases will consist of vapors only.

A DETAILED DESCRIPTION OF THE INVENTION

Figure 1:
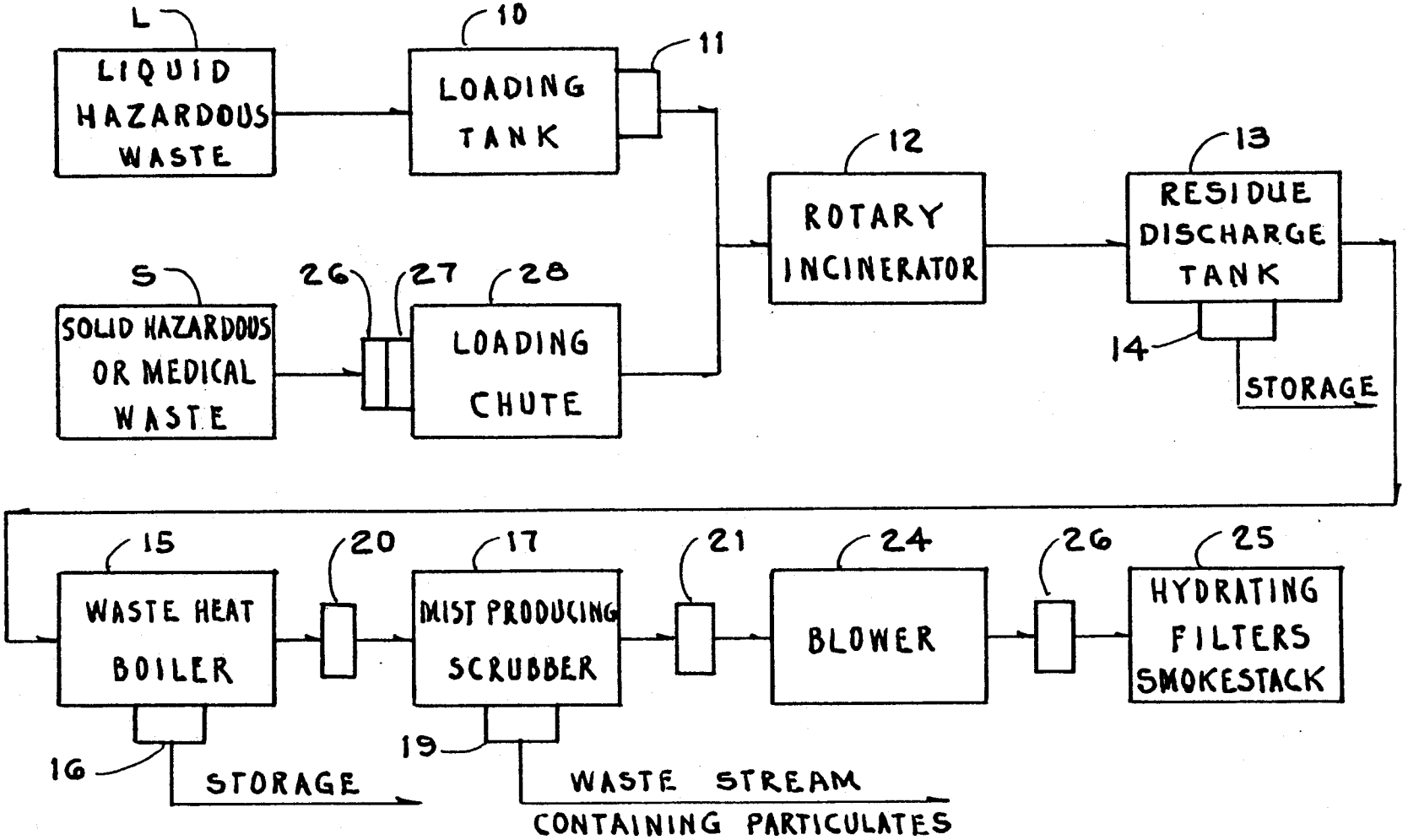
FIG. 1 is an overall flow diagram of the process of this invention of reducing liquid hazardous waste, solid hazardous waste and medical waste to a disposable residue.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

As illustrated in FIG. 1, liquid hazardous waste L is fed into loading tank 10. Loading tank 10 is equipped with a sluicegate 11, which controls effluent flow into rotary incinerator 12. Rotary incinerator 12 is placed on, for example, a four degree slope to constantly move and combust the waste.

Hazardous waste, being flammable but not explosive, creates much of its own heat when ignited. It is EPA's opinion that incinerating hazardous waste is a safe operation.

A heavy refractory lining, on the interior surface of incinerator 12, protects the shell from damage at the 2700 to 3000 degree (F) operating temperature used in reducing hazardous waste to a non-toxic residue.

Residue from incinerator 12 is discharged into tank 13. Heavy residue particles fall to the bottom of tank 13, where a belt conveyor 14 equipped with a heat resistant belt conveys the materials to a storage area.

In practice, the term "storage" may well mean that the residue may be required by environmental dictates to be buried in plastic lined underground dumpsites for a safe storage.

Liquid hazardous waste residue, being non-toxic after incineration, may have some useful industrial purposes or may also be buried in properly constructed dump sites.

Hot air with suspended particles rises up through tank 13 and is discharged into waste heat boiler 15. Boiler 15 absorbs heat from gases discharged from rotary incinerator 12. Water-cooled walls in boiler 15 reduce the temperature of the gases from approximately 2900 to 1500 degrees (F).

Baffle walls within boiler 15 extend the length of the path through which the hot gases must flow and also introduces a multiplicity of path direction changes in the flow of gases through the boiler. Because of these various direction changes good separation of particulate matter carried by gases is obtained as the gases move through the boiler. Particulate matter separated from the gases falls to the bottom of boiler 15. These residues are removed from boiler 15 by a screw conveyor 16 for transport to a storage area.

The steam created in boiler 15 may be utilized for generating power.

Air and suspended particles not entrapped in boiler 15 enter scrubber 17. Trough 19 at the base of scrubber 17 conveys water and particulate matter to a disposal or water purification recovery area.

Blower 24 draws the cooled gases and any remaining particulate matter from the scrubber 17 through blower 24 and projects them toward chimney 25.

Solid hazardous waste and medical waste are introduced to the system in a separate operation. Trucks dump waste materials into a below ground located hopper 26 from which it is moved by conveyor 27 into loading chute 28 where it is introduced into rotary incinerator 12.

Figure 2:
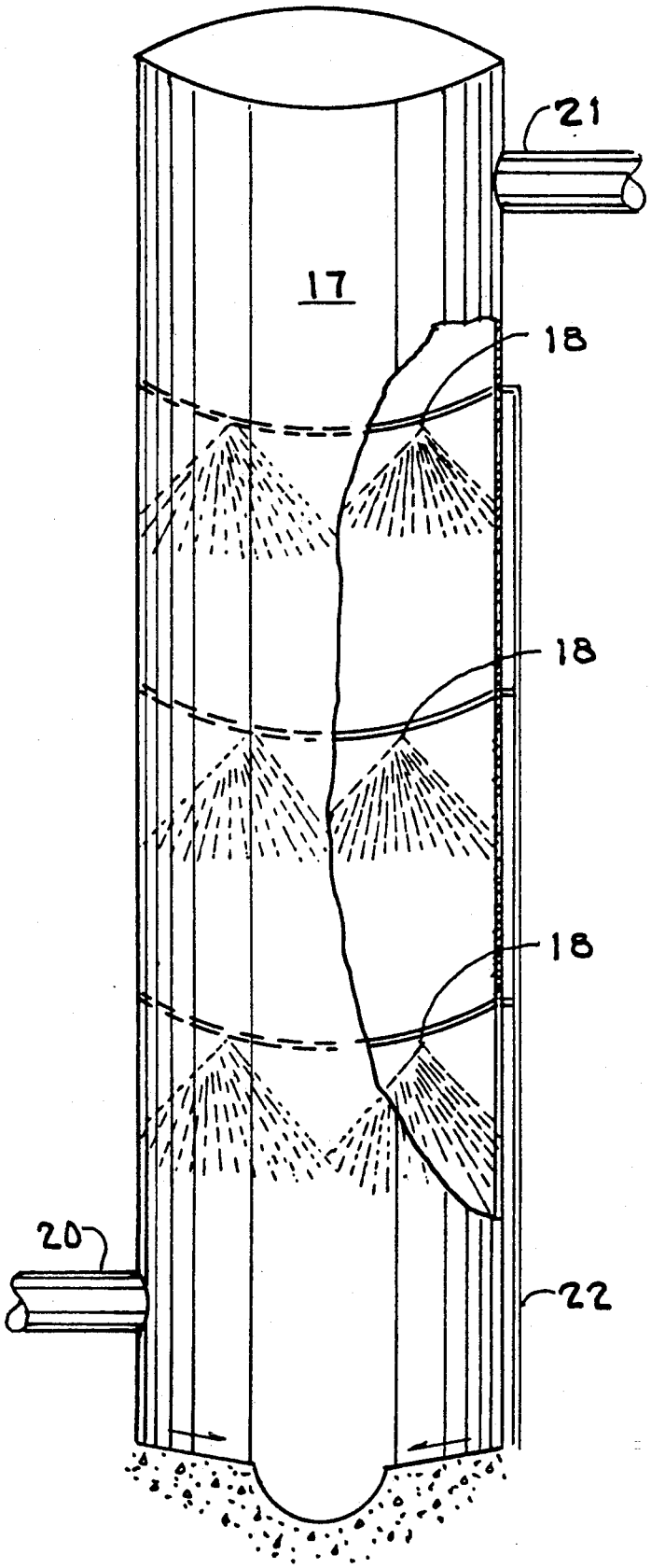
FIG. 2 is a cross section view of the mist-producing scrubber.

The illustration of FIG. 2 provides a perspective insight into the interior of scrubber 17. Air and suspended particles not entrapped in waste heat boiler 15 enter scrubber 17 through pipe 20.

Scrubber 17 is equipped with very fine mist-producing nozzles 18. Nozzles 18 are arranged within scrubber 17 at, for example, three separate elevations. The use of mist-producing nozzles 18 has a distinct advantage over the coarser jet producing nozzles used in the prior art. With prior art jet producing nozzles, the entire void within the scrubber was not filled with water. Particulate residues can rise through the scrubber passing between water jets, totally avoiding water contact. By using mist-producing spray nozzles in scrubber 17, as I disclose herein, the interior of scrubber 17 is totally filled with a water vapor mist through which particulate matter passes and increases in mass as it gathers moisture. The heavy wet particles fall to the bottom of the scrubber. No residue particles can avoid water contact in my mist filled scrubber 17 as was possible with prior art, jet producing sprays.

The basic philosophy is that if the drops of water are as small or smaller than the size of the particulate matter, the particles must interfere with the water mist in their attempt to rise in the scrubber. The particulate residue will thus be weighted down and carried to the bottom of the scrubber 17 by its increased density.

The mist producing nozzles 18 are supplied from feed water line 22 which is connected to a source of water, not shown.

Trough 19 at the base of scrubber 17 conveys water and particulate matter to a disposal or water purification recovery area. Blower 24, FIG. 1, draws the cooled gases and any remaining particulate matter from scrubber 17 through exit pipe 21.

Figure 3:
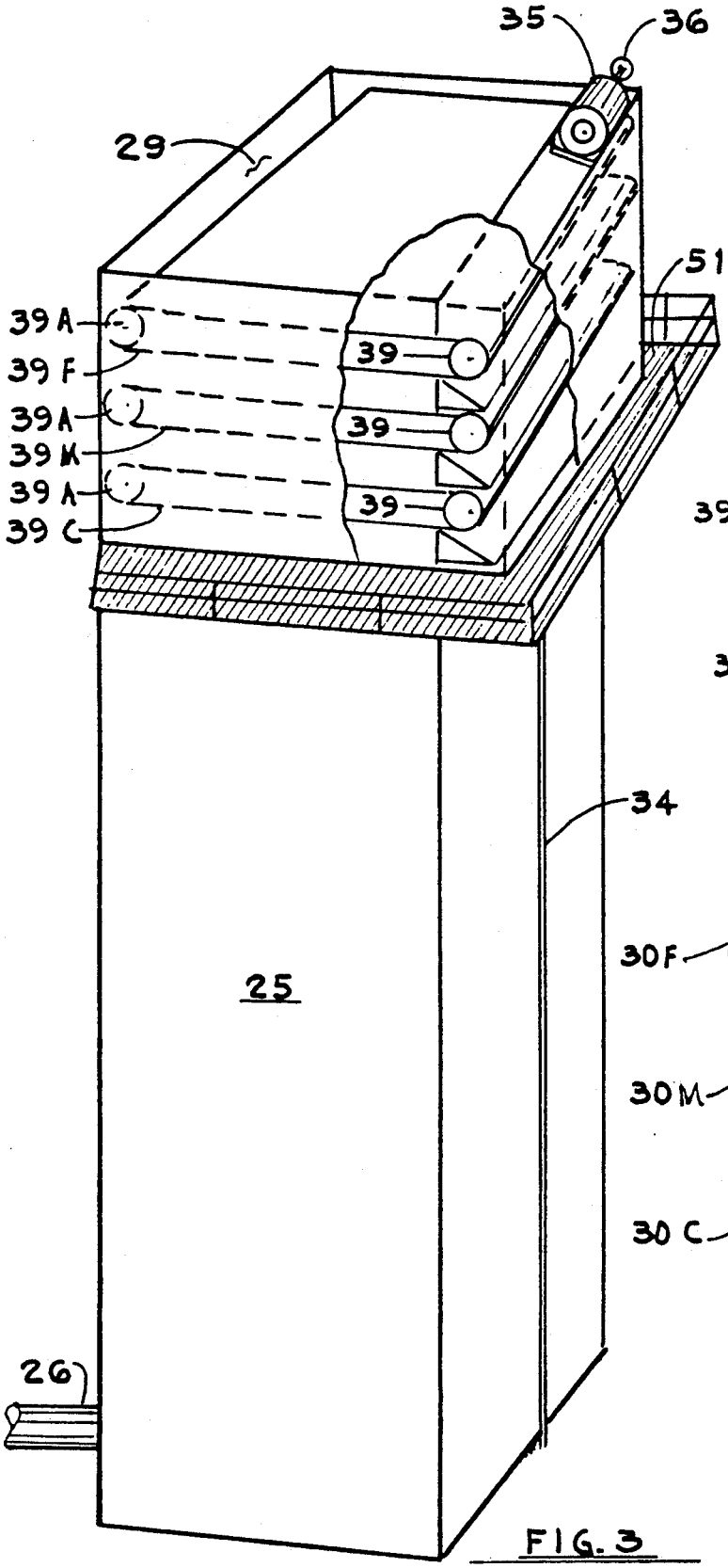
FIG. 3 is an overall view of the hydrating filter smokestack.

FIG. 3 presents an overall view of smokestack chimney 25. The residues and gases, projected by blower 24, pass through pipe 26 into chimney 25 and up the central portion 29 of chimney 25.

When the rising gases and particulate matter reach hydrating filters 30, hydrating filters 30 trap the particulates in the following process.

Hydrating filters 30 are graduated so that the lowest filter "30C" is a relatively coarse mesh, middle filter "30M" is a medium mesh and the top filter "30F" is a relatively fine mesh.

Figure 9:
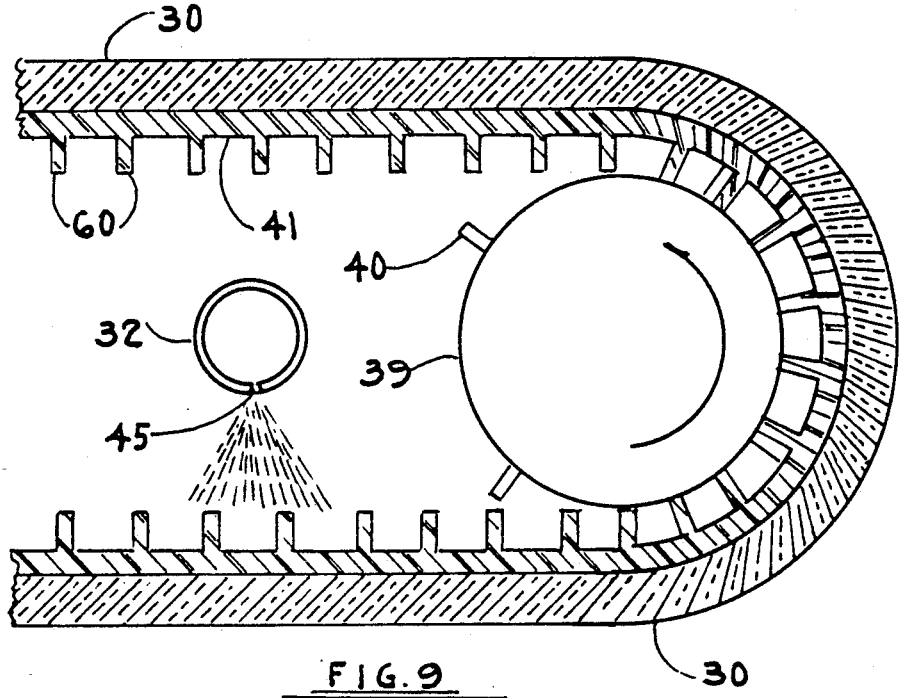
FIG. 9 is a sectional view showing the filter and its backing as it passes around the roller. The water spray for washing the filters is shown.

The rollers 39 and 39A, shown in FIG. 3 support filters 30, imparts motion to the filter mesh which moves across the chimney space 29 in an endless belt fashion as shown in FIG. 9.

Figure 5:
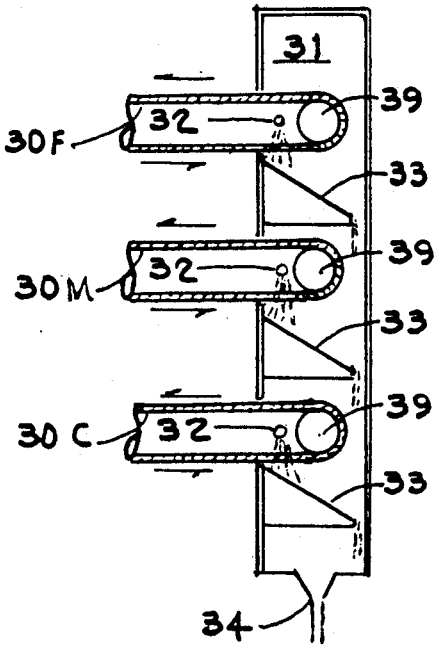
FIG. 5 is a view showing the filter washing system.

Filters 30 are constantly moving, having one region, the right end in the illustration of FIG. 3, extending outside air passage area 29 as shown in greater detail in FIG. 5. A filter washing area 31 is equipped with a pipe 32, perforated at the base to constantly wash the filters 30. A water supply, not shown, keeps constant pressure in pipe 32. Particulate matter collected on filter 30 is driven out of the filter by application of water sprayed from pipe 32.

Water with removed particulates is washed to a drain gutter 33 and thereafter down through space 31 to exit via spout 34. Thus filters 30 are cleaned continually and will prevent any contaminants from reaching the atmosphere. Water from spout 34 with collected particulate matter is funneled to a water purification recovery area (not shown).

Figure 4:
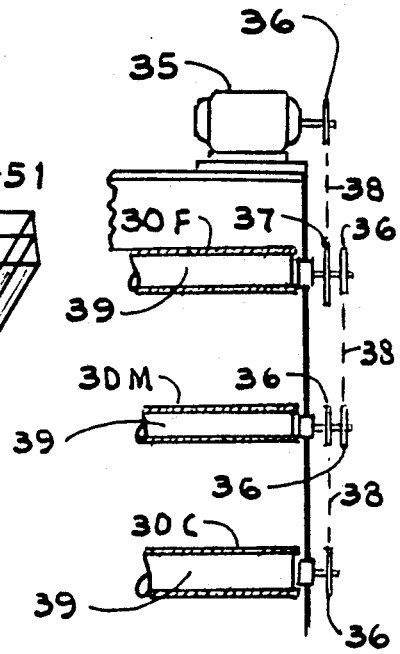
FIG. 4 shows the drive unit arrangement for rotating the filters.

FIG. 4 illustrates the drive arrangement for rotating hydrating filters 30. Motor 35 is wired for a moderately slow speed. Finer adjustment can be obtained by selectedly sizing pulleys 36 and 37. Belts 38 connect the pulleys 36 and 37 with drive unit 35.

Figure 11:
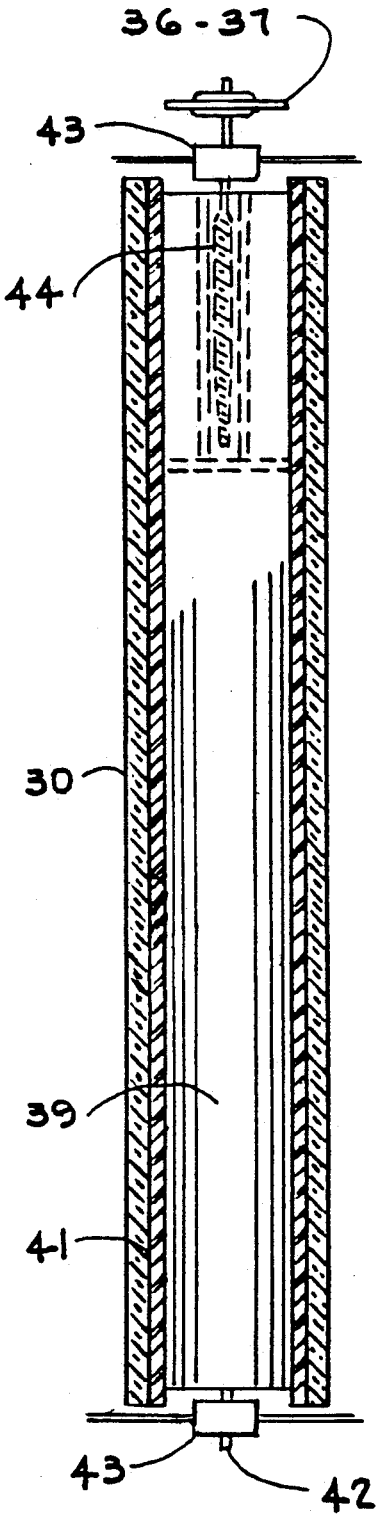
FIG. 11 is a cross sectional detail of the filter roller.
Figure 7:
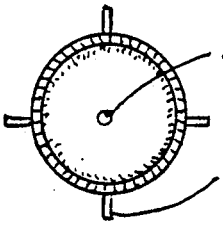
FIG. 7 is a left end view of the filter roller of FIG. 6.
Figure 6:
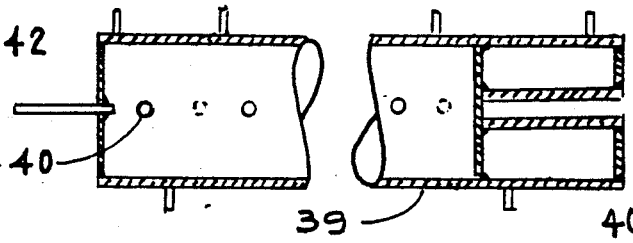
FIG. 6 is a cross section of the filter roller.
Figure 8:
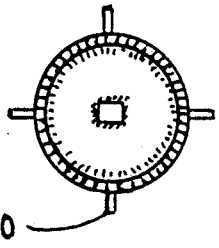
FIG. 8 is a right end view of the roller of FIG. 6.

Roller 39, shown in detail in FIGS. 6 and 9, is equipped with prongs 40 which mesh with filter backing 41 to rotate filters 30 as desired. Roller 39 has a round shaft 42 on one end (FIG. 7) which is inserted into bearing 43 as shown in FIG. 11. FIG. 8 shows the opposite end of roller 39. Shaft 44 shown in FIG. 11 has a circular cross section in the region which passes through the bearing 43 and belt pulley 36 and 37. That portion of shaft 44 inserted in roller 39 is square with a tapered end section for easier installation.

Figure 10:
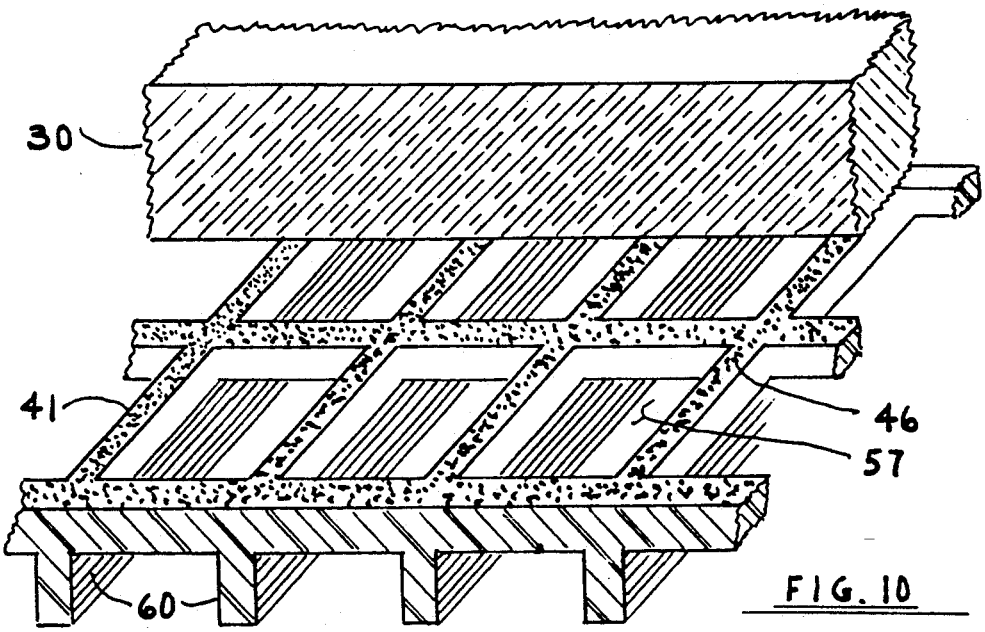
FIG. 10 is a detail of the filter and filter backing.

FIG. 10 is a partial sectional view of filter 30 and filter backing 41. Filter backing 41 is made of flexible material, for example a rubberized material. The surface of backing 41 common with filter 30 is coated with adhesive 46 for bonding filter 30 with backing 41. Backing 41 is designed with openings 57 between lateral strips 60. These strips run full width of backing 41. During the clean-out process, water sprayed from pipe 32 to backing 41, passes through openings 57 flows to drain gutter 33 and exits through spout 34.

The disclosure herein is intended to teach not only of improved scrubber 17, but is particularly intended to advance the state of the art by introducing hydrating filter chimney 25 in the field of hazardous and medical waste disposal treatment.

Those skilled in the art will conceive of other embodiments of the invention which may be drawn from the disclosure herein. For example, it is relatively easy to conceive of embodiment in which the waste heat boiler is by-passed, thus having the hot gases entering scrubber directly. To the extent that such other embodiments are so drawn, it is intended that they shall fall within the ambit of protection provided by the claims herein.

Having described the invention in the foregoing description and drawings in such a clear and concise manner, that those skilled in the art may readily understand and practice the invention, that which is claimed is:

1. In a waste elimination system wherein waste materials are incinerated in a manner productive of gaseous and particulate residues at the output of said system, said particulate residues being intermixed with and transported by said gaseous residues, the improvement comprising:

a hydrating filter smokestack coupled to said output of said system, said smokestack including therein a liquid-washed filter system into which said gaseous and particulate residues are injected, said particulate residues being thereby separated from said gaseous residues to prevent the venting of said particulate residues into the atmosphere;

said liquid-washed filter system comprising a movable, endless-belt filter.

2. The improvement of claim 1 wherein said liquid-washed filter system further comprises a wash-liquid supply coupled to said filter system and wash-liquid conduit means coupled to said wash-liquid supply for conducting wash-liquid to said filter system for flushing particulate residues entrapped within said filter system as said gaseous residues pass there through.

3. The improvement of claim 2 further comprising means coupled said to filter system for conducting away from said hydrating filter smokestack wash-liquid used for flushing said entrapped particulate residues from said filter system.

4. The improvement of claim 3 further comprising mist-filled scrubber means coupled between said output of said waste elimination system and said hydrating filter smokestack through which scrubber said gaseous and particulate residues are passed, both said gaseous and said particulate residues being cooled and said particulate residues being increased in density, a plurality of said particulate residues becoming thereby so dense as to become physically separated from said gaseous residues passing through said mist-filled scrubber means.

5. The improvement of claim 4 wherein said mist-filled scrubber includes means coupled to said scrubber for producing a mist of liquid particles of such minute size and quantity as to fill said scrubber such that all particulate residues passing through said scrubber will contact a plurality of said liquid particles.

6. The improvement of claim 5 wherein said mist-filled scrubber further comprises means coupled thereto for collecting such of said particulate matter as become physically separated from said gaseous residues.

7. The improvement of claim 2 wherein said wash-liquid supply comprises a water supply.

8. The improvement of claim 1 wherein said filter system further comprises means for flushing, from said endless-belt filter, particulate residues entrapped therein.

9. The improvement of claim 8 wherein said filter system further includes means for collecting liquids and residues flushed from said endless-belt filter.

10. The improvement of claim 9 wherein said filter system comprises a plurality of said movable, endless-belt filters.

11. The improvement of claim 1 wherein said filter system comprises a plurality of said movable, endless-belt filters.

12. The improvement of claim 11 further comprising mist-filled scrubber means coupled between said output of said waste elimination system and said hydrating filter smokestack through which scrubber said gaseous and particulate residues are passed, both said gaseous and said particulate residues being cooled and said particulate residues being increased in density, a plurality of said particulate residues becoming thereby so dense as to become physically separated from said gaseous residues passing through said mist-filled scrubber means.

13. The improvement of claim 12 wherein said mist-filled scrubber includes means coupled to said scrubber for producing a mist of liquid particles of such minute size and quantity as to fill said scrubber such that all particulate residues passing through said scrubber will contact a plurality of said liquid particles.

14. The improvement of claim 13 wherein said mist-filled scrubber means further comprises means coupled thereto for collecting such of said particulate matter as become physically separated from said gaseous residues.

15. The improvement of claim 1 further comprising mist-filled scrubber means coupled between said output of said waste elimination system and said hydrating filter smokestack through which scrubber said gaseous and particulate residues are passed, both said gaseous and said particulate residues being cooled and said particulate residues being increased in density, a plurality of said particulate residues becoming thereby so dense as to become physically separated from said gaseous residues passing through said mist-filled scrubber means.

16. The improvement of claim 15 wherein said mist-filled scrubber includes means coupled to said scrubber for producing a mist of liquid particles of such minute size and quantity as to fill said scrubber such that all particulate residues passing through said scrubber will contact a plurality of said liquid particles.

17. The improvement of claim 16 wherein said mist-filled scrubber means further comprises means coupled thereto for collecting such of said particulate matter as become physically separated from said gaseous residues.

18. The improvement of claim 1 wherein said hydrating filter smokestack comprises:

an open-top, enclosed void into which said gaseous and particulate residues are injected to rise through said void toward said open top;

said movable, endless-belt filter being emplaced within said void to intercept said gaseous and particulate residues and entrap particulate residues;

a portion of said endless-belt filter extending out of and returning in to said void;

flushing means coupled to said portion of said endless-belt filter extending out of said void for flushing from said portion of said endless-belt filter particulate residues entrapped therein; and collection means for collecting particulate residues flushed from said endless-belt filter.

19. The improvement of claim 18 wherein said endless-belt filter further comprising a plurality of movable, endless-belt filters emplaced sequentially in said void, each of said plurality being of selected mesh size, and each of said plurality sequentially intercepting said gaseous and particulate residues rising through said void.

20. In a waste elimination system wherein waste materials are incinerated in a manner productive of gaseous and particulate residues at the output of said system, said particulate residues being intermixed with and transported by said gaseous residues through a scrubber means removing particulate residues from said gaseous residues, the improvement comprising:

said scrubber means being a mist-filled scrubber through which said gaseous and particulate residues are passed, both said gaseous and particulate residues being cooled in passage, said particulate residues being increased in density, a plurality of said particulate residues becoming thereby so dense as to become physically separated from said gaseous residues passing through said mist-filled scrubber;

means coupled to said mist-filled scrubber for producing liquid particulates of such minute size and quantity as to fill said scrubber such that all particulate residues passing through said scrubber will contact a plurality of said liquid particles; and collecting means coupled to said mist-filled scrubber for collecting such of said particulate matter as become physically separated from said gaseous residues.

* * * * *